United States Patent [19]

Conn

[11] 4,245,775

[45] Jan. 20, 1981

[54] TWO-WAY POSTAL CARD AND ENVELOPE

[76] Inventor: John L. Conn, P.O. Box 4501 Sta. B, Spartanburg, S.C. 29303

[21] Appl. No.: 83,257

[22] Filed: Oct. 10, 1979

[51] Int. Cl.[3] ..... B65D 27/04; B65D 27/06

[52] U.S. Cl. ..... 229/71; 229/73; 229/92.8

[58] Field of Search ..... 229/71, 73, 92.3, 92.8

[56] References Cited

U.S. PATENT DOCUMENTS

| | | | |
|---|---|---|---|
| 2,383,652 | 8/1945 | Holmblad et al. | 229/71 X |
| 2,941,711 | 6/1960 | Biek | 229/73 |
| 3,181,774 | 5/1965 | Littman | 229/71 X |
| 3,288,351 | 11/1966 | Benz, Jr. | 229/71 |
| 3,380,648 | 4/1968 | De Lyra | 229/71 |

FOREIGN PATENT DOCUMENTS

| | | | |
|---|---|---|---|
| 711690 | 9/1941 | Fed. Rep. of Germany | 229/71 |
| 393896 | 11/1965 | Switzerland | 229/73 |
| 994 | of 1914 | United Kingdom | 229/71 |

*Primary Examiner*—Stephen P. Garbe

[57] ABSTRACT

In combination, a two-way postal card and cover envelope having the ability to be mailed out and then refolded to use said cover and envelope again wherein the positioning of the enclosed message card will automatically completely re-address said postal card so to be re-mailed again when stapled together.

2 Claims, 8 Drawing Figures

TWO-WAY POSTAL CARD AND ENVELOPE

BACKGROUND OF THE INVENTION

1. Field of the Invention

This invention relates to the common postal card that is used to send a message by mail and more particularly it refers to a two-way postal card wherein the message card is first used to mail out and then the card and cover envelope is re-positioned and automatically re-addressed to be returned to the original sender.

Postal cards have been known for years but the construction of a two-way postal card and envelope wherein the re-folding of the card and envelope will automatically re-address said and make ready for re-mail by simply re-positioning said message card and cover envelope is Novel.

The postal card and envelope is designed for bulk type mail that is sent out and a reply is requested. The cover envelope and message card is preferably constructed from durable paper or the like.

2. Brief Summary of the Invention

It is therefore a primary object of this invention to provide an improved two-way postal card and envelope that can be mailed out and then returned to the original sender.

It is another object to provide a two-way card that can be sealed or stapled together and after being closed the addressee can be written thereupon.

To construct a two-way postal card and cover envelope, that when received from the first party, the second party can re-position or re-fold the message card and envelope wherein said will automatically completely re-address said cover envelope and message card to be re-mailed to the original sender.

BRIEF DESCRIPTION OF THE DRAWINGS

The accompanying drawings, which are incorporated in and constitute a part of this specification illustrate one design of the invention and, therefore with a description serve to explain the principles of the invention.

OF THE DRAWINGS

Figure 1:
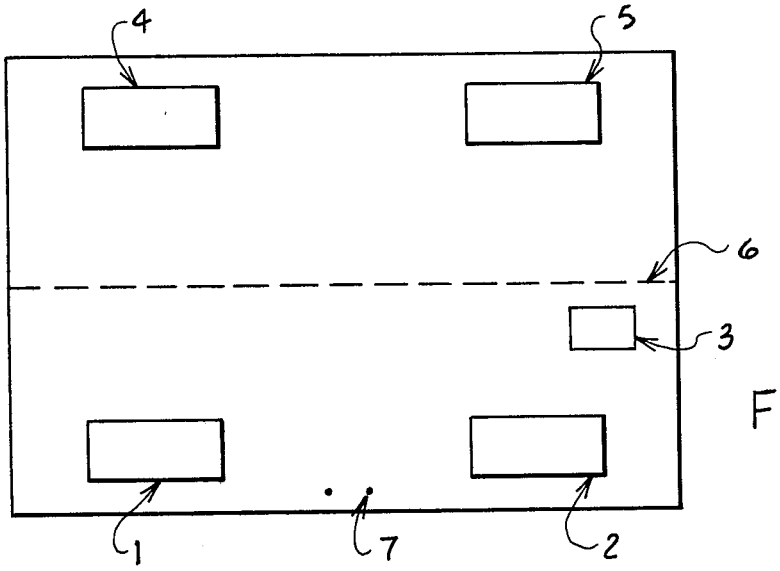

FIG. 1 is a flat view of one side of the cover envelope as it is first mailed out to an addressee (Envelope not being folded).

Figure 2:
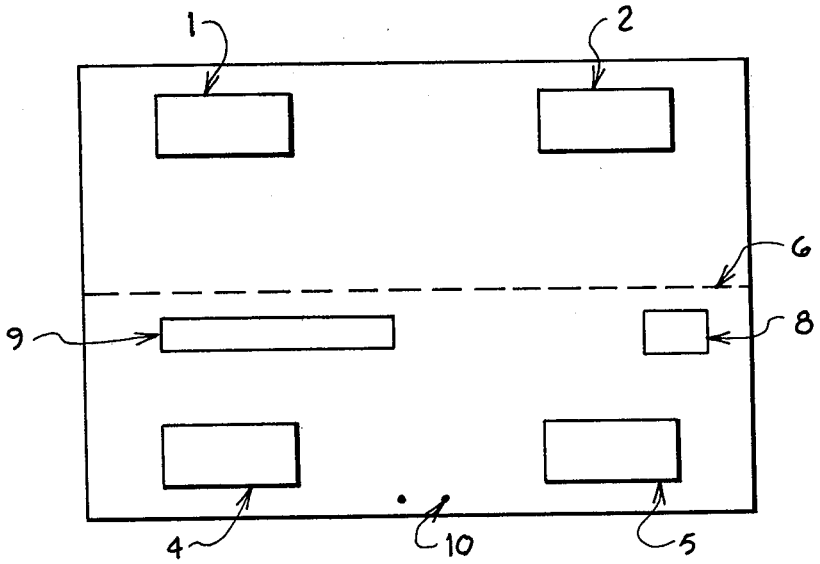

FIG. 2 is a flat view of the opposite side of the cover envelope as it is used to re-mail back to the original sender (Envelope not being folded).

Figure 3:
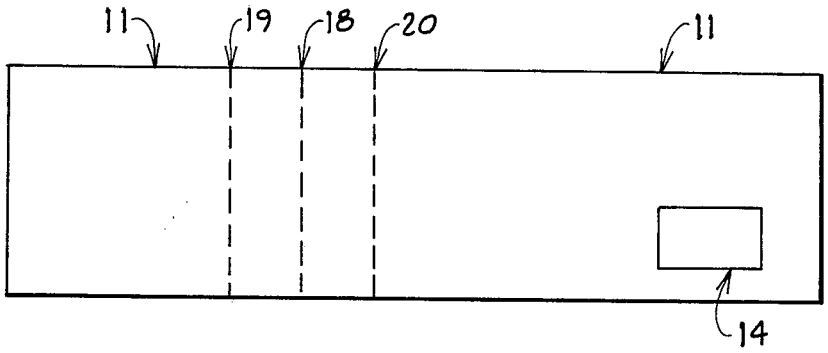

FIG. 3 is a flat view of one side of the message card in the complete open position.

Figure 4:
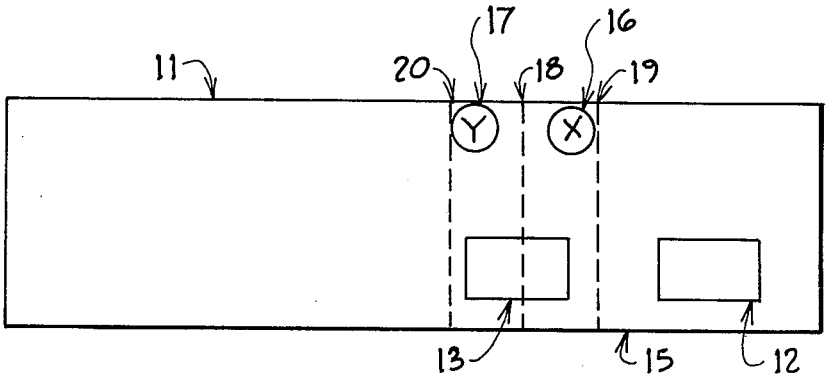

FIG. 4 is a flat view of the opposite side of the message card in the complete open position.

Figure 5:
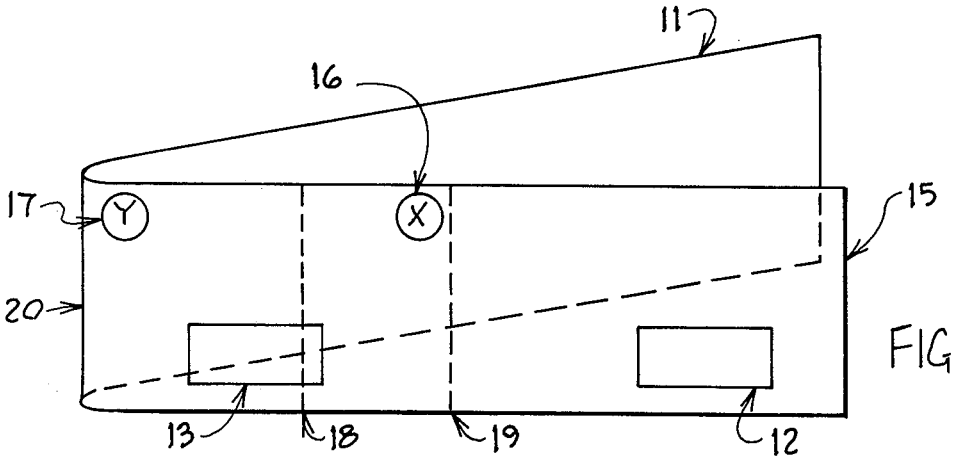

FIG. 5 is a folded view of the message card as positioned when card is first mailed out. (The cover envelope not shown over card).

Figure 6:
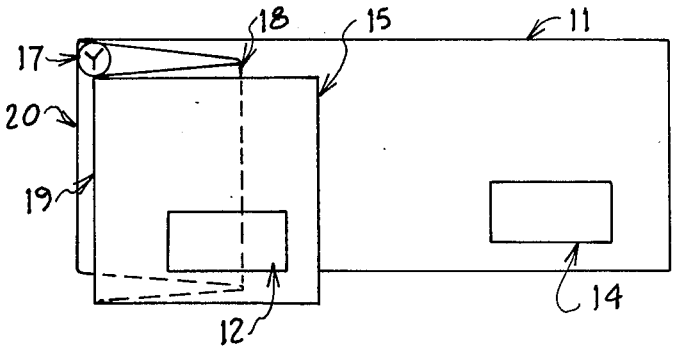

FIG. 6 is a folded view of the message card positioned to be placed inside the cover envelope so to be re-mailed or returned to the original sender. (The cover envelope not shown over card).

Figure 7:
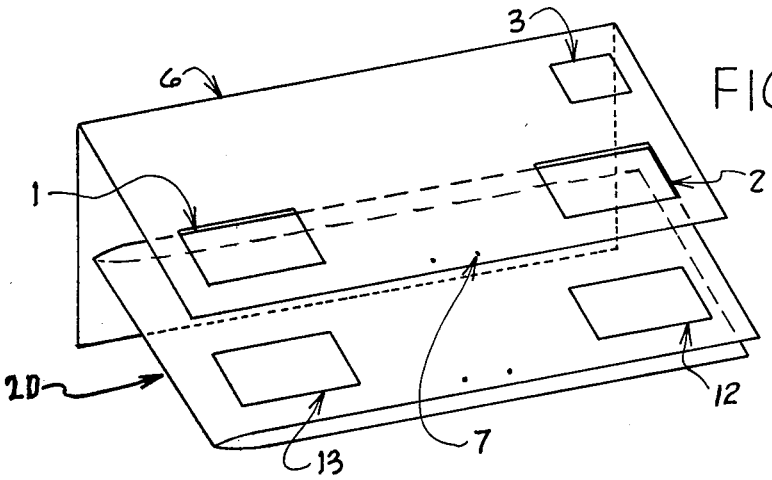

FIG. 7 is a folded view of the cover envelope and message card at a partly open position as said is first mailed out. (Not being stapled or closed).

Figure 8:
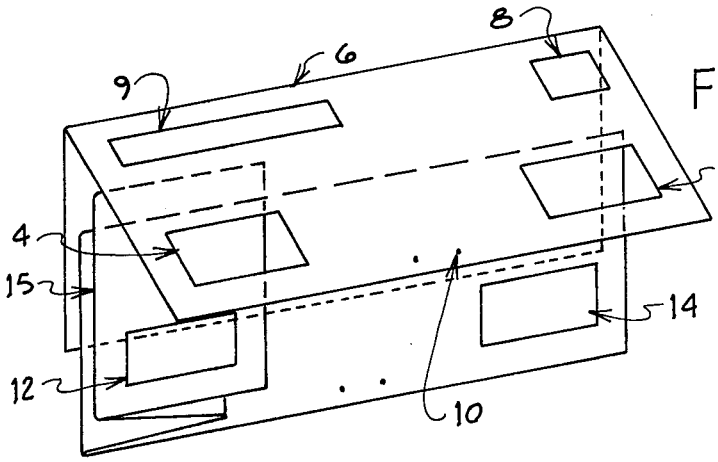

FIG. 8 is a folded view of the cover envelope and message card at a partly open position as said is re-mailed to the original sender. (Not being stapled or closed).

DETAILED DESCRIPTION OF THE INVENTION

Referring now to the drawings and more particular to (FIG. 1) which represents the cover envelope having two cut out address windows (1 and 2) that are used to display the addresses when the message card is first mailed out (FIG. 5) and showing the postage stamp (3) as per (FIG. 7) wherein the cover envelope (FIG. 1) contains two opposite address windows (4 and 5) that are used to display the addresses when the message card (FIG. 6) is returned to the original sender as per (FIG. 8).

The cover envelope (FIG. 1) is folded at the central area (6) to cover the message card (FIG. 5) and stapled at the central bottom area (7) completely through the now folded message card (FIG. 5) and positioned inside the cover envelope as in FIG. 7 and stapled together (7) to be mailed out the first time.

The opposite side of the cover envelope (FIG. 2) when folded (6) will display the two address windows (4 and 5) and the business reply mail area (9) and the collect postage stamp area (8) as said is folded (6) and positioned to be re-mailed to the original sender as in (FIG. 8) wherein said is re-stapled together (10), thus the one cover envelope will serve as a two-way envelope wherein one message card will serve as a two-way card.

To mail out the two-way postal card will be as follows:

The message card; (FIG. 3 and FIG. 4) is of course, pre-printed displaying the sender's address (13 and 14), and message (11); is folded at the central area (20) and placed inside the cover envelope as in FIG. 7 wherein the entire envelope and card is stapled together at area (7) wherein the addressee is typed or written on the card's window area (12) through the envelope's window area (2). The message card being addressed (12) while inside the envelope (FIG. 7) wherein a stamp (3) is placed on the envelope wherein said is ready to be mailed out.

To return this two-way postal card will be as follows:

The cover envelope (FIG. 2) is folded (6) so to display the business reply (9) and the no postage necessary area (8) wherein the message card is folded as shown in FIG. 6 at the card's central creased area (20) wherein said top card is folded leftward 180 degrees at the creased area (18) so to position the marked area (X) (16) over the marked area (Y) (17) wherein the remaining left end of the top card is folded (19) to the right 180 degrees so to automatically position the message card (Now FIG. 6) and place said in proper mailing order wherein the original addressee (12) window (2) does now become the addressor and will now be displayed at the envelope's window (4) thus the two-way card being properly addressed so to be re-mailed when the card is stapled (10) inside the envelope. The original sender's address (14) thus being displayed on the card at the envelope's window (5).

The right portion of the card above the original addressee's position (12) will contain instructions (15) as follows, "To return card—Fold to left so (X) is positioned over (Y). This will automatically re-address when placed inside cover. Be sure to staple together to close or seal."

The rectangular shaped message card is equal in length and width as the cover envelope when the message card is folded linearly at the central creased area (20) wherein the now folded top one-half of the message card is creased at its central area (19) wherein the remaining left one-half of said top message card is creased at its central area (18) so to permit said message card to be re-positioned for re-mailing.

Advantages of this two-way postal card are as follows:

1. Conserves materials since the envelope and card is used two times.

2. Automatically re-addresses the card so to be remailed.

3. Saves time in preparing to mail out since the card needs only to be stapled inside the envelope and then the addressee is placed through the envelope window and said is ready to mail out.

4. The message contents are not exposed as related to the common postal card now in use.

While various changes may be made in the general design it is hoped that such changes will not alter the spirit and scope of the present invention as defined by the claims.

What is claimed:

1. In combination, the construction of a two-way postal message card and envelope wherein the envelope is constructed from a flat sheet of paper or the like wherein said sheet is folded or creased along a centrally located line so as to form upper and lower areas which are substantially rectangular in shape and substantially equal in length and width, said areas being appoximately the size of a common postal card, at least one of said areas including cut-outs which form a mailing address window and a return address window which are generally horizontally aligned with one another, said message card being constructed from a flat sheet of paper or the like having a length which is approximately twice the length of each of said areas and a width which is appoximately the same as the width of each of said areas, said message card being divided into approximately equal FIRST and SECOND PORTIONS by means of a first substantially vertical fold line, said message card further including FIRST and SECOND SURFACES on opposite sides thereof, SAID FIRST PORTION including an initial mailing address and an initial return address generally horizontally aligned and positioned ON SAID FIRST SURFACE so as to be aligned with said mailing and return address windows in said envelope when said message card is folded about said vertical fold line and inserted into said envelope, said first portion including a second approximately vertical fold line located between said initial and return addresses and dividing said first portion into substantially equal left and right parts, said initial mailing address being located in said right part and said initial return address being located in said left part, said left part including a third substantially vertical fold line dividing it substantially in half, said second portion including a remailing address on the second surface thereof, said remailing address being located in aligned, underlying relationship with said initial mailing address when said message card is folded in half and the second surface of said first portion is in substantially complete contacting relationship with the second surface of said second portion, said first portion being additionally foldable about said second and third substantially vertical fold lines so as to cover up said initial return address with said initial mailing address and expose said remailing address, said initial mailing address and said remailing address being in substantially horizontal alignment.

2. The combination of claim 1 further including two additional cut-outs in the other of said areas, said cut-outs forming mailing address and return address windows which directly underlie the other two windows in the completed envelope.

* * * * *